United States Patent [19]

Jansson

[11] 4,353,520

[45] Oct. 12, 1982

[54] LARGE OPEN CARRIER WITH A FOLDABLE CARGO SUPPORTING WALL

[76] Inventor: Hadar J. E. Jansson, Wachtmeistersv 27, Helsingborg, Sweden

[21] Appl. No.: 189,952

[22] PCT Filed: May 18, 1979

[86] PCT No.: PCT/SE79/00111

§ 371 Date: Jan. 18, 1980

§ 102(e) Date: Jan. 18, 1980

[87] PCT Pub. No.: WO79/01117

PCT Pub. Date: Dec. 27, 1979

[30] Foreign Application Priority Data

May 25, 1978 [SE] Sweden ..... 7806041
May 25, 1978 [SE] Sweden ..... 7806042
May 25, 1978 [SE] Sweden ..... 7806043

[51] Int. Cl.[3] ..... B65D 19/12

[52] U.S. Cl. ..... 248/346; 16/75; 108/55.1; 108/56.1

[58] Field of Search ..... 108/55.1, 56.1; 248/346; 16/80, 75; 220/1.5; 206/386, 600

[56] References Cited

U.S. PATENT DOCUMENTS

| | | | |
|---|---|---|---|
| 823,372 | 6/1906 | Stevens et al. | 16/80 |
| 1,547,956 | 7/1925 | Reinhold | 16/80 |
| 3,307,734 | 3/1967 | Campbell | 16/75 |
| 3,748,687 | 7/1973 | Romberg | 16/75 |
| 3,752,332 | 8/1973 | Theurer | 108/56.1 X |
| 4,099,640 | 7/1978 | Nessfield et al. | 220/1.5 X |
| 4,131,071 | 12/1978 | Glassmeyer | 108/56.1 X |
| 4,240,359 | 12/1980 | Howe | 108/53.1 |

*Primary Examiner*—William E. Lyddane
*Attorney, Agent, or Firm*—Beveridge, DeGrandi and Kline

[57] ABSTRACT

The present invention relates to an apparatus in large open goods carriers, so called container-flats, which display a loading plane (1) and at least one wall unit (2, 3), for example an end wall unit, which is fixedly retained in the loading plane for pivotal switching from a rest position, in which the wall unit (2, 3) is located in or parallel with the loading plane (1), and a working position, in which the wall unit (2, 3) makes substantially a right angle with the loading plane (1).

The anchorage of the wall unit (2, 3) consists of a hinge means with a shaft in or on which one end of at least one torsion bar (20, 21) is disposed in a non-rotary manner, the torsion bar extending longitudinally with the pivotal shaft (18) of the pivotal wall unit (2, 3), the other end of the torsion bar (20, 21) being disposed in a non-rotary manner in the loading plane (1), and that the torsion bar (20, 21) is tension-free in a position on the wall unit (2, 3) between its rest position and working position.

11 Claims, 10 Drawing Figures

LARGE OPEN CARRIER WITH A FOLDABLE CARGO SUPPORTING WALL

BACKGROUND OF THE INVENTION

The present invention relates to an apparatus in large, open goods carriers, so-called container-flats, which display a loading plane and at least one wall, for example an end wall, which is fixedly retained in the loading plane for pivotal switching from a rest position in which the wall is located in or parallel to the loading plane, and a working position in which the wall makes substantially a right angle with the loading plane.

Load carriers of the container-flat type are used primarily for transport by means of vessels or on lorries, and must possess a very high level of stability in order to withstand the associated heavy and often careless handling they are subjected to. These load carriers are also of considerable size and, therefore, heavy, the end wall or wall alone weighing from 400 to 500 kg. Raising and lowering of the end walls entails, therefore, great problems. According to French Patent Specification No. 2,348,857 and U.S. Pat. No. 3,752,332, it is known to facilitate the swining-up of the end wall by means of per se conventional helical springs. However, these are ill-suited to the task since they are space-consuming and must be completely built-in in order that the risk of damage be eliminated. Furthermore, they can very easily be put out of action as a result of the collection of dirt and rubbish.

Furthermore, it is desirable to be able to lock the end walls in the operative or working position and, according to French Patent Specification No. 2,315,442 and U.S. Pat. Nos. 3,568,608 and 3,735,713, it is known to lock the end walls by means of pins which are inserted into mutually corresponding holes. However, such constructions entail inconvenience, since great accuracy is required in their manufacture and also in the alignment of the holes with each other before the pins can be inserted in them.

The problem which forms the basis of the present invention is that of obviating the inconveniences inherent in the prior art constructions and, thereby, to realise an apparatus whose end walls or walls are easier to manipulate between the rest position and the working position and which are easier to lock in the working position. Furthermore, it is desirable to realise as stable and reliable a hinge construction as possible for the pivotal end wall units or walls.

SUMMARY OF THE INVENTION

According to the present invention, the above-disclosed technical problem is solved in that the anchorage of the wall consists of a hinge means with a shaft in or on which one end of at least one torsion bar is disposed in a non-rotary manner, the other end of the torsion bar being mounted in non-rotary manner in the loading plane, and that the torsion bar is tension-free in a position on the wall unit between its rest position and working position. According to the present invention, an apparatus for locking the wall unit in the working position is characterized in that the pivotal wall unit displays a hole which, in the working position of the pivotal wall unit, is at least partly in register with at least one hole in the loading plane, a wedge being provided on one end of a rod which is shiftably disposed in the loading plane for insertion of the wedge into the hole which is provided with two spaced apart abutment or stop means, and an impact member is shiftably mounted on the rod between the abutment means for driving-in and driving-out of the wedge into and out of the holes. According to the present invention, an apparatus for forming a portion of a hinge means for the anchorage of the wall unit in the loading plane is characterized in that said portion of the hinge means is in the form of an L-shaped, hollow box with a bottom, rear piece and sides, the foot being turned in to face towards the loading plane and the end of the stack having a cover with a recess, and a further portion of the hinge means is in the form of an angle member whose one shank is pivotally journaled between the sides of the box by means of a shaft in the foot and whose other shank is fixedly retained in the wall unit and fits in the recess.

According to the invention, by disposing torsion bars in the manner disclosed according to the invention, a construction will be obtained which requires minimum space and makes for an apparatus which, in particular from the construction point of view, is highly economical, is functionally reliable and is easy to operate. By locking the end wall unit by means of a wedge, the holes in the different parts need not agree exactly in alignment with each other but need merely agree partially, such that a portion of the wedge may be inserted, whereupon a further portion of the wedge may be driven in by means of the impact member disposed on their rods, when the impact member is caused to strike the suitable abutment means on the rod. A further advantage resides in the fact that the impact member is always in place on the rod with the wedge, whereby no loose or extra tools will be required for driving-in or driving-out of the wedge. A hinge means construction according to the present invention is extremely stable and functionally reliable.

DESCRIPTION OF THE ACCOMPANYING DRAWINGS

DESCRIPTION OF THE PREFERRED EMBODIMENTS

Figure 1:
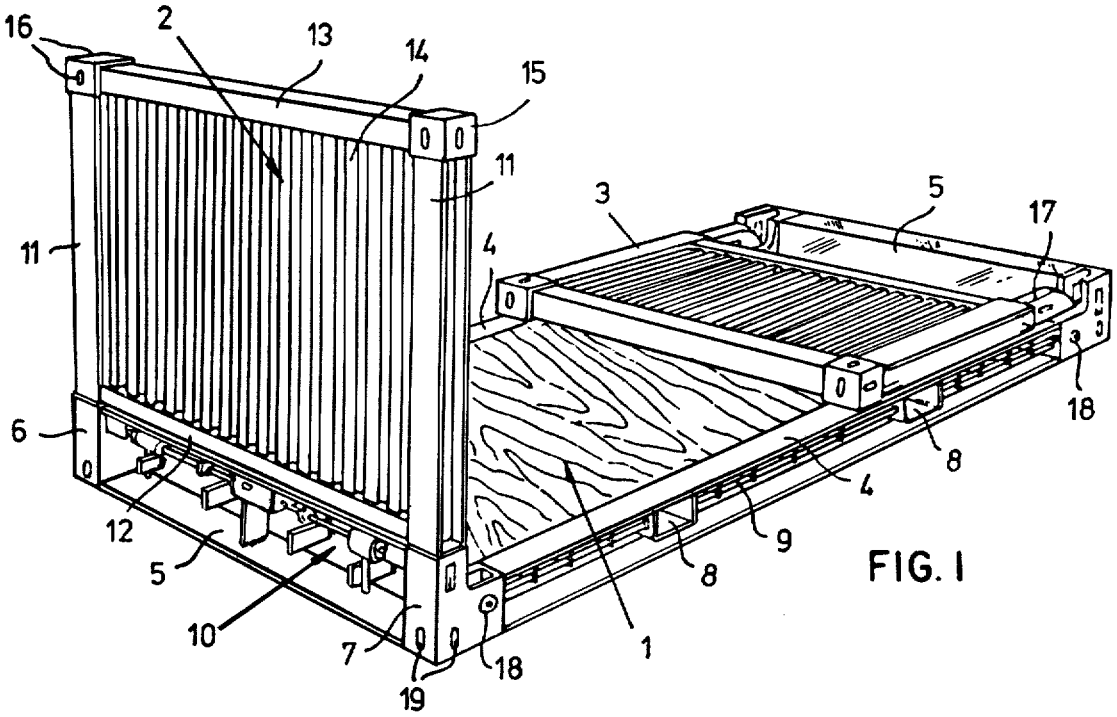
FIG. 1 is a perspective view of one embodiment of an apparatus according to the present invention.

In FIG. 1 is shown a load carrier, a so-called container-flat according to the present invention which has a loading plane or bottom 1 with a pivotal end wall unit 2, 3 at opposing ends. The one end wall unit 2 is shown in the raised and locked working position for the transport of goods, whereas the other end wall unit 3 is shown in the lowered rest position for the empty transport of the goods carrier.

The bottom 1 is in the form of a frame with longitudinal and transverse frame beams, the two longitudinal outer frame beams 4 being interconnected by means of end beams 5 via corner pieces 6 and 7. The frame beams 4 support transverse, open box beams 8 for the insertion of the forks of a lift truck. The frame beams 4 also have longitudinal rods 9 for the anchorage of webbing and the like. The end beams 5 support means 10 for locking the end wall units in the working position and possibly also in the rest position.

The end wall units have side beams 11, a bottom beam 12 and a top beam 13, the space between them being filled by means of an end wall unit sheet metal plate 14 or the like. The side beams 11 have end fittings 15 with standardised holes 16 for the anchorage of lifting devices and the like. The side beams 11 are, at the lower end, provided with an angular member 17 with a hole for a pivot pin 18, the corner pieces 6 and 7 having corresponding holes for the pivot pin 18. The corner pieces 6 and 7 also display standardised holes 19 for lifting devices and the like.

Figure 2:
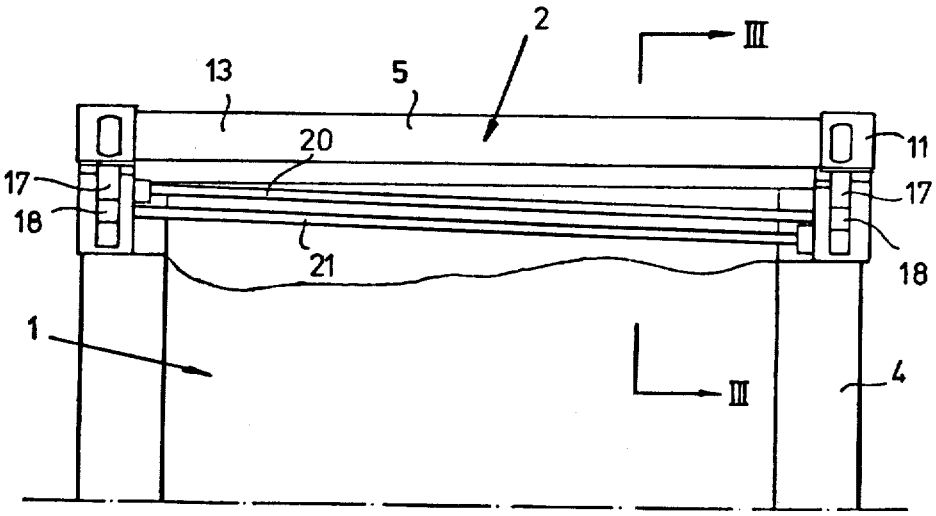
FIG. 2 is a partial view of the apparatus of FIG. 1, certain parts having been removed.
Figure 3:
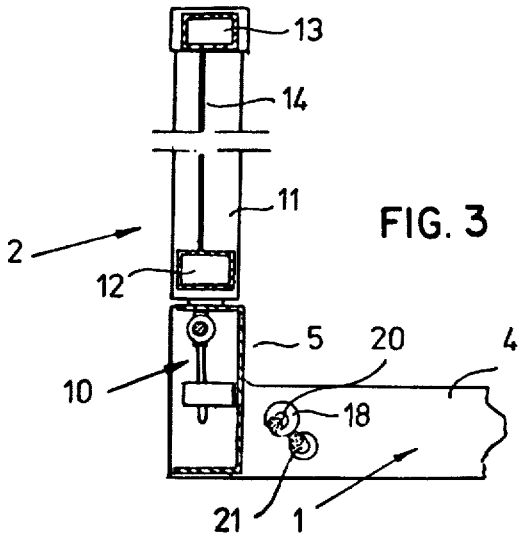
FIG. 3 is a section taken along the line 3—3 in FIG. 2.
Figure 4:
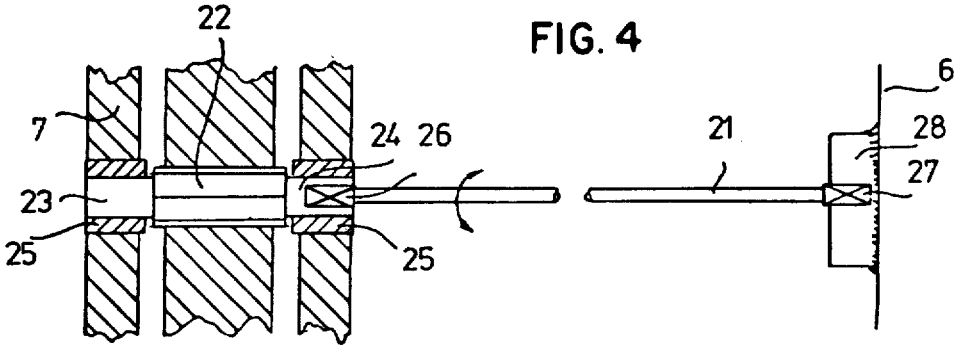
FIG. 4 shows, on a larger scale, a partial section of the apparatus of FIG. 2.

FIGS. 2, 3 and 4 show in greater detail how the end wall units 2 and 3 are spring-biased by means of torsion bars 20 and 21 which extend transversely of the loading plane and which are mounted for action in directions opposite to one another. The torsion bar 20 is, with its right-hand end, mounted in the angular member 17 of the end wall unit 2, preferably coaxial with the pivot pin 18, whereas its left-hand end is mounted in a non-rotary manner in the loading plane 1. The other torsion bar 21 is, with its left-hand end, mounted in the angular member 17 whereas its other end is mounted in a non-rotary manner in the loading plane. The anchorage is shown in greater detail in FIG. 4, the pivot pin or shaft 18 being in the form of a pin of polygonal cross-section, for example a hexagonal pin, whose ends 23 and 24 have been rounded-off by machining. The two ends are, by means of journals 25, pivotally disposed each in a part of the corner pieces. The angular member 17 has holes of the same polygonal cross-section as the pin 22 so that the same is pivotted together with the angular member 17. One end 24 of the pin 22 has an inner square hole for fitting onto a square end of the torsion bar 21. The opposite end of the torsion bar 21 is also provided with a square end 27 which is inserted into a locking boss 28 which is fixedly connected to some portion of the loading plane, in this case the corner piece 6. On pivoting of the end wall unit and, therewith, the angular member 17, one end of the torsion bar will be twisted, whereas the other end will remain fixed. As was mentioned above, both of the torsion bars 20 and 21 are mounted for action in directions opposite to each other, but otherwise in the same manner.

Figure 5:
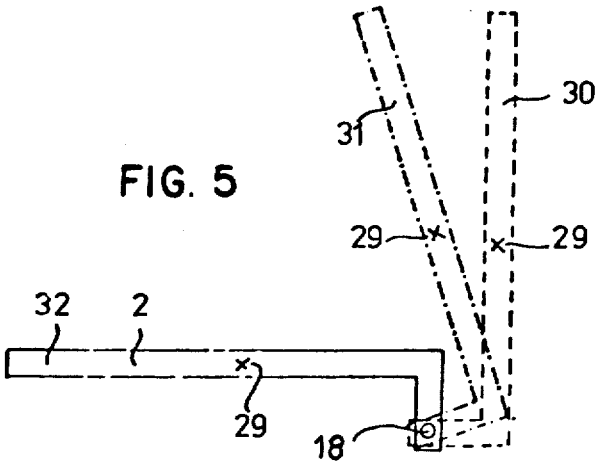
FIG. 5 is a schematic view of an end wall unit in different positions.

According to FIG. 5, the centre of gravity 29 of the end wall unit 2 is offset from the pivot shaft 18 of the end wall unit, for which reason the end wall unit 2 will strive to remain in the raised position, the working position , as shown by means of broken lines. The dead-point position or unloaded position is attained with the end wall unit in the position shown by means of dash-dot lines, when the point of gravity 29 is located straight above the pivot shaft 18. The torsion bars 20 and 21 are mounted for action against each other, whereby will be obtained a cooperation for switching the end wall unit from its vertical position 30 to its dead-point position 31 and a counter action on lowering of the end wall unit from the dead-point position 31 to the rest position 32. The torsion bars 20, 21 may suitably be mounted load-free, when the end wall units 2, 3 are located in the dead-point position 31. The torsion bars 20, 21 will, thus, facilitate raising of the end wall units 2, 3 to the working position.

Figure 6:
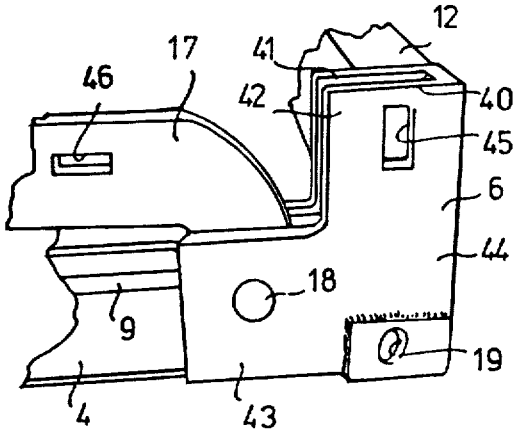
FIG. 6 is a perspective view of a part of the apparatus of FIG. 1.

According to FIG. 6, the corner piece 6 is designed as an angular box with groove which forms two shanks 41 and 42, between which the angular member 17 of the end wall unit is inserted. The angular member 17 is, by means of the pivotal shaft or pivotal pin 18, connected to the shanks in the horizontal portion 43 of the corner piece 6. The vertical portion 44 is, at its upper end, provided with elongate vertical holes 45. The angular member 17 of the end wall unit is provided with a similar hole 46. The hole 45 is slightly higher and wider than the hole 46, which facilitates insertion of a locking device in the holes, when the end wall units 2 and 3 are located in the working position.

Figure 7:
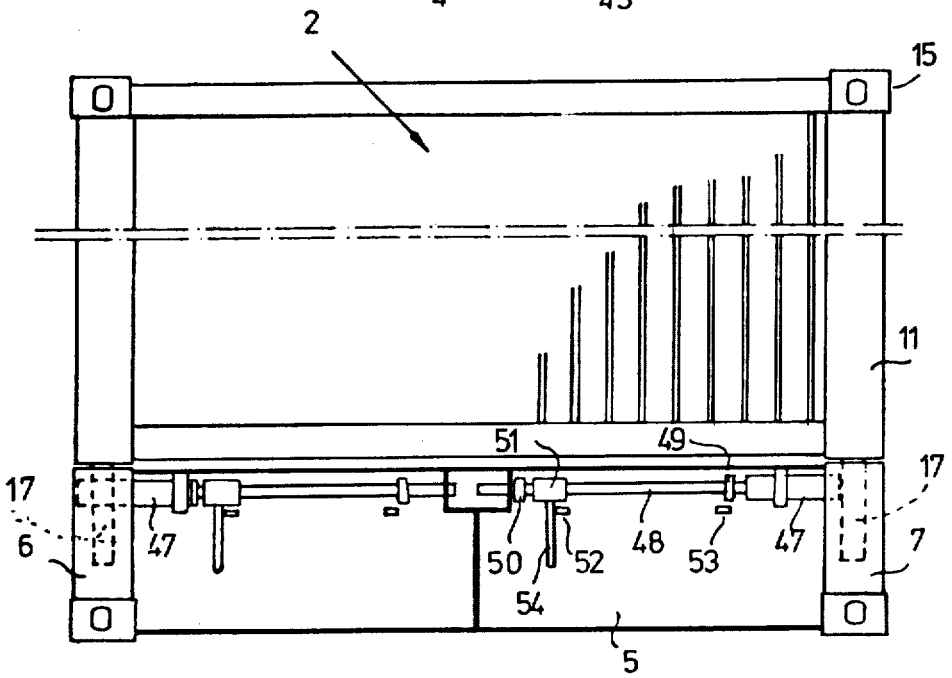
FIG. 7 is an end elevation of the apparatus of FIG. 1.
Figure 8:
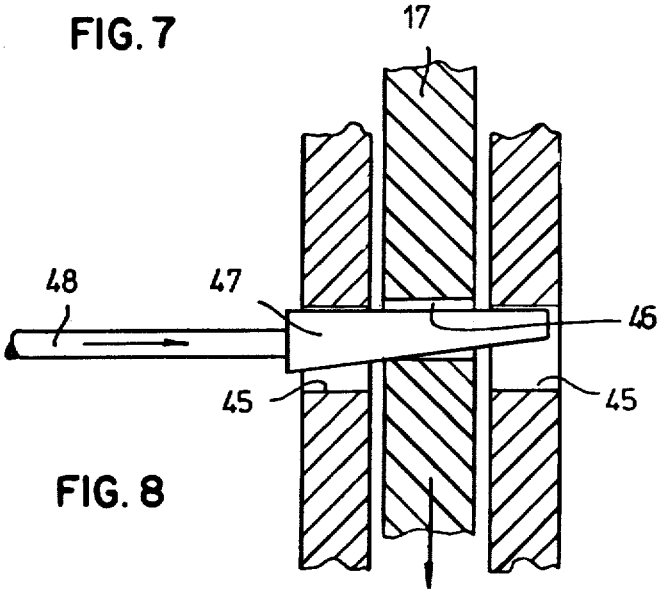
FIG. 8 is a section of a part of the apparatus of FIG. 7.

According to FIGS. 7 and 8, the load carrier according to the present invention has a separate locking device for each end wall unit 2, 3. The locking device consists of a flat wedge 47 which is fixedly mounted in the end of a rod 48 which is axially shiftable in the end beam 5.

The rod 48 supports two collars 49 and 50 of which one collar 49 is disposed for driving in the wedge 47, whereas the other collar 49 is disposed for driving out the wedge 47. An impact member 51 is shiftably disposed between the collars 49 and 50. The impact member or hammer 51 is adjustable in two positions by means of arrest bosses 52 and 53, in which positions the impact member 51 is not shiftable on the rod 28. To the left in FIG. 7 is shown the impact member 51 secured in one position with the wedge 47 driven into the holes 45 and 46, and, to the right in FIG. 7 is shown the impact member 51 in the opposing position with the wedge 47 in a non-locking position. The impact member 51 has a shaft 54 for cooperation with the arrest bosses 52 and 53 and for manoeuvering of the impact member. The side of the wedge 47 which faces the centre of the load carrier may be parallel to the end wall unit 2, 3 (FIG. 8) whereas the opposite side of the wedge is inclined towards that end which is turned to face away from the rod 48. During driving-in of the wedge 47, one side of the wedge can, as is apparent from FIG. 8, abut against the inner edge of the holes 45, and the opposite side of the wedge 47 against the outer edge of the hole 46, whereby the angular member 17 and, thereby, the end wall unit 2, 3, will be forced towards the working position. The driving-in operation is effected in that the impact member 51 is flung by means of the shaft 54 against the collar 49, whereas the driving-out operation of the wedge 47 is effected in that the impact member 51 is flung against the collar 50.

Figure 9:
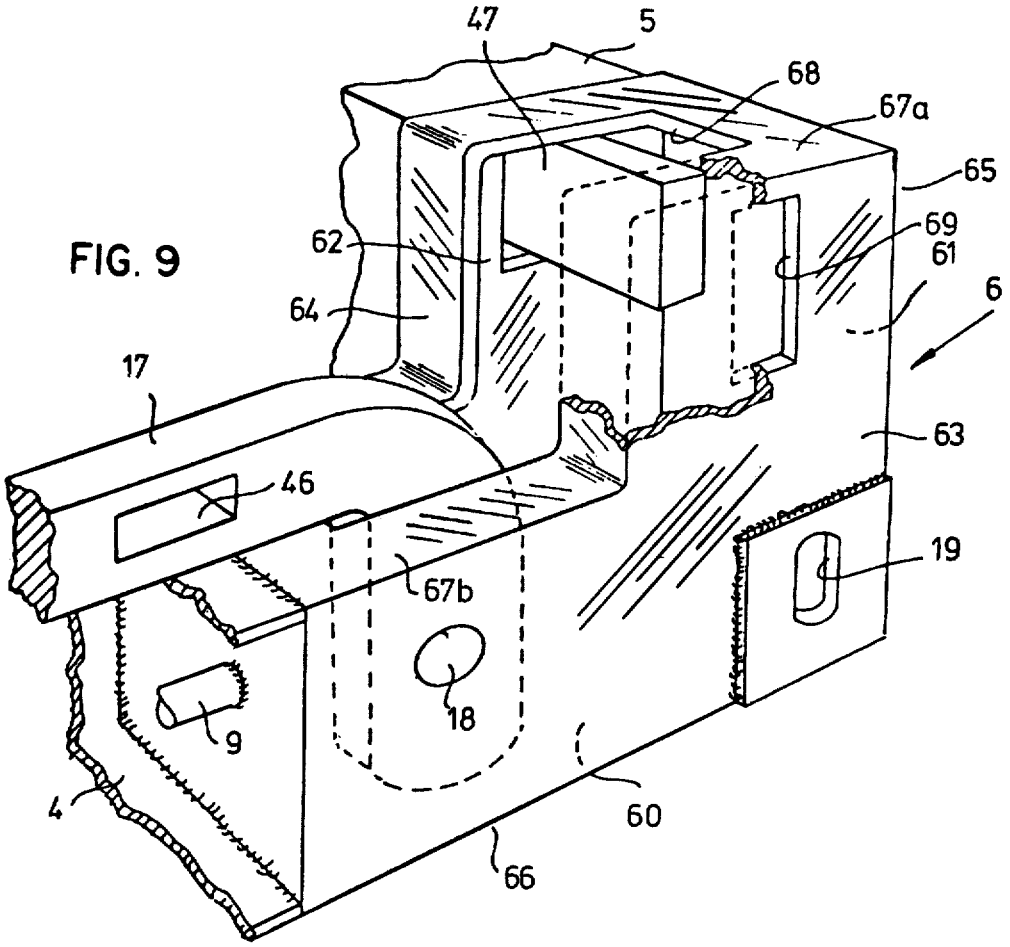
FIG. 9 shows, on a larger scale, a perspective view which is almost identical to that of FIG. 6.

As is apparent from FIG. 9, each corner piece 6 may be designed as a hollow box with a bottom 60, rear piece 61, sides 62, 63 and front piece 64. The box is substantially L-shaped, the shanks 65 extending up to or immediately above the upper edge of the angular member 17 of the lowered end wall unit 2, 3, whereas the foot 66 forms the hinge means portion for the end wall units 2, 3, in that the pivotal shaft 18 is mounted between the sides 62 and 63. The box has a cover **67*a*, 67*b* with a recess 68 which also extends through the front piece 64. The recess 68 forms a guide for the angular member 17 and, in particular in the raised, working position of the end wall units 2, 3, the recess 68 guides the angular member 17 laterally and imparts stability to the apparatus. The recess 68** may also serve as an anchorage means for separate coupling devices which are utilised for coupling a plurality of load carriers with the end wall units in the rest position above each other in the event of empty transport.

Figure 10:
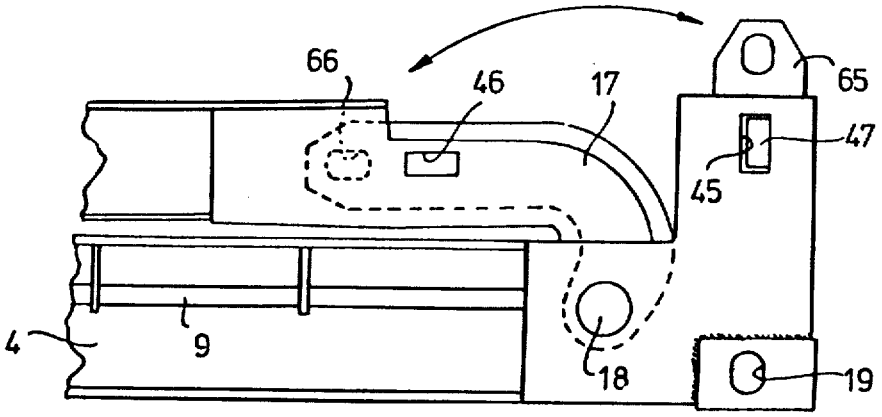
FIG. 10 shows a coupling method.

FIG. 10 shows an arrangement for realising coupling of load carriers with each other, for empty transport and with the end wall units 2, 3 in the rest position. In this arrangement, a coupling means 65 is disposed collapsibly in the angular member 17. The coupling means 65 is pivotal on the shaft 18 independent of the angular member 17. The coupling means 65 is, like the angular member 17, provided with the hole 46 and may, therefore, cooperate with the wedge 47 and the holes 45. Furthermore, the coupling means 65 is provided with a hole 66 for coupling to a suitable device on another load carrier.

I claim:

1. An apparatus comprising a loading plane and at least one wall unit, said wall unit being fixedly disposed in the loading plane for pivotal switching from a rest position, wherein said wall unit is located parallel to the loading plane, and a working position, wherein said wall unit makes substantially a right angle with the loading plane, wherein said wall unit is anchored in the loading plane by a hinge means at each of two corners, each of said hinge means comprising a shaft connected in a non-rotary manner with an end of a torsion bar, the other end of each torsion bar being disposed in a non-rotary manner in said loading plane close to said shaft of the other hinge means, such that said torsion bars cross each other and are positioned, relative to a pivotal shaft, to allow pivoting of said wall unit on said pivotal shaft, and wherein said torsion bars are tension-free when said wall unit is at a position between said rest position and said working position.

2. The apparatus according to claim 1, wherein said wall unit is an end wall unit.

3. The apparatus according to claim 1, wherein said wall unit is located in said loading plane when said wall unit is in said rest position.

4. The apparatus as recited in claim 1, wherein the pivotal wall unit (2, 3) has an angular member (17) at each one of the corners adjacent the loading plane (1); and that the angular member (17) is connected to the loading plane (1) each by means of a stub shaft (22) which is pivotal in the loading plane (1) and disposed in a non-rotary manner in the angular member (17) preferably by means of groove-shaft assemblies; that the shaft ends turned to face in towards the loading plane (1) each display a central coupling hole for non-rotary insertion of a correspondingly designed end (26) on the torsion bars (20,21), whereas the opposite end (27) of the torsion bars (20,21) is non-rotatably disposed in the loading plane (1) in the proximity of the stub shaft (22) of the opposing angular member (17).

5. The apparatus as recited in claim 4, wherein the torsion bars (20,21) are tension-free in a position on the pivotal wall units (2,3) in which their centre of gravity (29) is located straight above the pivotal shaft (18) when the loading plane is horizontal.

6. The apparatus as recited in claim 1, wherein the pivotal wall unit (2, 3) comprises a hole (46) which, in the working position of the pivotal wall unit (2, 3) at least partially agrees with at least one hole (45) in the loading plane (1); that a wedge (47) is disposed on one end of a rod (48) which is shiftably disposed in the loading plane (1) for insertion of the wedge (47) in the holes (45, 46); that the rod (48) is provided with two spaced apart abutment means (49, 50); and that an impact member (51) is shiftable on the rod (48) between the abutment means (49, 50) for driving-in and driving-out of the wedge (47) into and out of the holes (45, 46), whereby the wall unit (2, 3) can be locked in and unlocked from said working position.

7. The apparatus as recited in claim 6, wherein the holes (45,46) are substantially rectangular; and that the wedge is a flat wedge (47).

8. The apparatus as recited in claim 6, wherein the hole (45) in the loading plane (1) is longer and wider than the hole (46) in the pivotal wall unit (2,3).

9. The apparatus as recited in claim 6, wherein the loading plane (1) is provided with an end beam (5) with ends (6,7); that the pivotal wall units (2,3) have a side beam (11, 17); that the ends (6,7) display shanks (41,42) on each side of one end (17) of the side beam (11) in the working position thereof; and that the shanks (41,42) each have a hole (45) in alignment with each other on either side of the hole (46) in the side beam end (17).

10. The apparatus as recited in claim 6, wherein the rod (48) is round; that the impact member (51) is provided with a shaft (54) and both are shiftable and rotatable on the rod (48); and that the loading plane (1) in the proximity of the bar (48) has arrest bosses (52,53) for engagement with the shaft (54) for the prevention of unintentional driving-in and driving-out of the wedge (47).

11. The apparatus as recited in claim 6, wherein the wedge (47) has a first side surface which is parallel to the pivotal wall units (2,3) in its working position, the opposite side surface of the wedge (47) being inclined at an angle to the first side surface of the wedge facing away from the rod (48) and outwardly.

* * * * *